US008167676B2

(12) United States Patent
Martin et al.

(10) Patent No.: US 8,167,676 B2
(45) Date of Patent: May 1, 2012

(54) FLUORESCENT LIGHTING SYSTEM

(75) Inventors: John T. Martin, Riverside, CA (US); Lucien Tournie, Rowland Heights, CA (US); Douglas Gene Lockie, Los Gatos, CA (US)

(73) Assignee: VAXO Technologies, LLC, Walnut, CA (US)

( * ) Notice: Subject to any disclaimer, the term of this patent is extended or adjusted under 35 U.S.C. 154(b) by 424 days.

(21) Appl. No.: 12/456,714

(22) Filed: Jun. 19, 2009

(65) Prior Publication Data

US 2010/0320915 A1 Dec. 23, 2010

(51) Int. Cl.

| | |
|---|---|
| ***H01J 9/00*** | (2006.01) |
| ***H05B 33/10*** | (2006.01) |
| *H01J 1/62* | (2006.01) |
| *H01J 63/04* | (2006.01) |
| *H01J 11/04* | (2011.01) |
| *H01J 13/48* | (2006.01) |
| *H01J 15/04* | (2006.01) |
| *H01J 17/36* | (2006.01) |
| *H05B 37/00* | (2006.01) |
| *H05B 39/00* | (2006.01) |
| *H05B 41/00* | (2006.01) |

(52) U.S. Cl. ..... 445/26; 313/483; 315/326

(58) Field of Classification Search ..... None
See application file for complete search history.

(56) References Cited

U.S. PATENT DOCUMENTS

| | | | | |
|---|---|---|---|---|
| 3,308,342 | A * | 3/1967 | Coradeschi | 315/242 |
| 3,824,428 | A | 7/1974 | Spira | |
| 4,520,294 | A * | 5/1985 | Iida et al. | 315/50 |
| 4,686,428 | A * | 8/1987 | Kuhnel et al. | 315/307 |
| 4,937,505 | A * | 6/1990 | Deglon et al. | 315/307 |
| 5,010,274 | A * | 4/1991 | Phillips et al. | 315/101 |
| 5,034,661 | A * | 7/1991 | Sakurai et al. | 315/207 |
| 5,105,125 | A * | 4/1992 | Yang | 315/209 R |
| 5,541,477 | A | 7/1996 | Maya | |
| 5,631,523 | A | 5/1997 | Rothenbuhler | |
| 5,648,700 | A * | 7/1997 | Chu et al. | 313/493 |
| 5,675,941 | A * | 10/1997 | Dykmans | 52/81.6 |
| 5,757,111 | A | 5/1998 | Sato | |
| 5,765,941 | A * | 6/1998 | Vest | 362/260 |
| 5,811,941 | A * | 9/1998 | Barton | 315/307 |
| 5,818,172 | A | 10/1998 | Lee | |
| 5,955,847 | A | 9/1999 | Rothenbuhler | |

(Continued)

FOREIGN PATENT DOCUMENTS

| | | |
|---|---|---|
| GB | 2 246 034 | 1/1992 |

(Continued)

OTHER PUBLICATIONS

Glazebrook, Sir Richard, A Dictionary of Applied Physics, 1922, Macmillian and Company, vol. II. p. 388 <online> <retrieved on Oct. 8, 2011><URL: http://books.google.com>.*

(Continued)

*Primary Examiner* — Douglas W Owens
*Assistant Examiner* — Dedei K Hammond
(74) *Attorney, Agent, or Firm* — Thomas N. Giaccherini

(57) ABSTRACT

Methods and apparatus for providing a Fluorescent Lighting System are disclosed. In one embodiment, the present invention may be used as a fluorescent lamp ballast which is controlled using a non-resonant circuit that allows the ballast to lower to fifty percent the light output of the lamp while providing a corresponding fifty percent reduction in energy used.

38 Claims, 11 Drawing Sheets

U.S. PATENT DOCUMENTS

| | | | | |
|---|---|---|---|---|
| 6,037,722 | A | 3/2000 | Moisin | |
| 6,069,453 | A * | 5/2000 | Arts et al. | 315/209 R |
| 6,218,787 | B1 | 4/2001 | Murcko | |
| 6,300,728 | B1 * | 10/2001 | Blackburn et al. | 315/307 |
| 6,584,714 | B1 * | 7/2003 | Wehrmann et al. | 40/546 |
| 6,879,113 | B2 | 4/2005 | Nemirow | |
| 6,952,945 | B2 | 10/2005 | O'Brien | |
| 7,414,372 | B2 | 8/2008 | Ribarich | |
| 7,812,544 | B2 * | 10/2010 | Morales et al. | 315/209 R |
| 2005/0128666 | A1 * | 6/2005 | Pogodayev et al. | 361/58 |
| 2005/0134196 | A1 | 6/2005 | Cook | |
| 2006/0215345 | A1 * | 9/2006 | Huizenga | 361/173 |
| 2006/0285108 | A1 | 12/2006 | Morrisroe | |
| 2007/0217206 | A1 * | 9/2007 | Bayat et al. | 362/362 |
| 2007/0228994 | A1 * | 10/2007 | Hung et al. | 315/247 |
| 2007/0278959 | A1 * | 12/2007 | Ikada et al. | 313/634 |
| 2008/0073565 | A1 | 3/2008 | Jeon | |

FOREIGN PATENT DOCUMENTS

| | | |
|---|---|---|
| WO | WO2006/114577 | 11/2006 |

OTHER PUBLICATIONS

Wikipedia, "Gas-filled tube" <online>.<Retrieved on Oct. 8, 2011><URL:http://en.wikipedia.org/wiki/Gas-filled_tube>.*

* cited by examiner

Conventional Fluorescent Lamp

PRIOR ART

PRIOR ART

Conventional
Incandescent
Light Bulb

PRIOR ART

FLUORESCENT LIGHTING SYSTEM

FIELD OF THE INVENTION

One embodiment of the present invention pertains to methods and apparatus for providing fluorescent lighting. More particularly, one embodiment of the invention comprises a method for stimulating and maintaining the efficient operation of a fluorescent tube.

FEDERALLY SPONSORED RESEARCH OR DEVELOPMENT

None.

BACKGROUND OF THE INVENTION

Introduction: The Fluorescent Lamp

Over 500 million fluorescent lamps are sold in the United States every year. Sales of "fluorescent lumiline lamps" commenced in 1938, when four different sizes of tubes were introduced to the market. During the following year, General Electric and Westinghouse publicized the new lights through exhibitions at the New York World's Fair and at the Golden Gate Exposition in San Francisco. Fluorescent lighting systems spread rapidly during World War II, as wartime manufacturing intensified lighting demand. By 1951, more light was produced in the United States by fluorescent lamps than by incandescent lamps.

How a Fluorescent Lamp Works

FIG. 1 depicts a generalized version of a conventional fluorescent lamp, which comprises a sealed glass tube filled with a gas that is maintained at very low pressure. When the gas is excited by applying an electrical current across the ends of the tube, particles generated by the excited gas strike the coating on the inside of the tube, and the coating emits visible light. (See GE Lighting, How It Works and Westinghouse Light Bulbs websites.)

A generalized pictorial view of a fluorescent lamp is depicted in FIG. 2. The fluorescent lamp is usually filled with a gas containing low pressure mercury vapor and argon, xenon, neon, or krypton. The pressure inside the lamp is around 0.3% of atmospheric pressure. The inner surface of the bulb is coated with a fluorescent (and often slightly phosphorescent) coating made of varying blends of metallic and rare-earth phosphor salts. The tube has two electrical terminals, a cathode and an anode. The cathode is typically made of coiled tungsten. This coil is coated with a mixture of barium, strontium and calcium oxides (chosen to have a relatively low thermionic emission temperature). When the light is turned on, the electric power heats up the cathode, and it begins to emit electrons into the lamp enclosure. The mercury atoms in the fluorescent tube must be ionized before the arc can "strike" within the tube. The electrons emitted from the cathode collide with and ionize noble gas atoms in the bulb surrounding the filament, and form a plasma by a process of impact ionization. The ultraviolet light is absorbed by the bulb's fluorescent coating, which re-radiates the energy at longer wavelengths to emit visible light. (See Wikipedia.)

A conventional incandescent light is shown in FIG. 3. An electrical current flows through a metal filament in an evacuated glass bulb. The electricity heats the wire filament, which produces a glow of visible light. A conventional incandescent light bulb is "electrically stable," meaning that when the bulb is turned on, current flows through the filament at a relatively steady rate, and light is produced until the bulb is turned off. A fluorescent tube, by itself, is "electrically unstable." When power is applied to an uncontrolled fluorescent light, more and more power flows into the lamp, and, eventually, the lamp burns up and is destroyed. This unfortunate result is due to an electric characteristic of the fluorescent lamp, which is based on the electrical property called "resistance." In general, resistance is a characteristic of a substance to carry or convey a flow of electricity. Metals, like copper, gold and silver, are the best conductors of electricity, and have relatively low resistance. Insulators, like glass or plastics, do not allow electricity to pass, and, in general, have a relatively high resistance.

In a conventional incandescent light bulb, the resistance of a heated filament is relatively constant. In other words, once power is applied to a conventional light bulb, the filament heats up, and the amount of electricity that flows through the bulb remains about the same until the power is switched off.

In a conventional fluorescent lamp, after the power is initially supplied to the electrodes of the fluorescent lamp, the gas inside the tube is excited, and its electrical resistance begins to fall. More electricity flows into the lamp when the resistance drops, and the cycle continues unabated until so much current flows into the lamp, that the lamp is destroyed by excessive heat.

Controlling the Fluorescent Lamp: The Ballast

The operation of conventional fluorescent lamps may be controlled by using an external device, called a "ballast," which limits and regulates the current flow through the tube. The ballast may be a simple electrical component called a "resistor," which limits the flow of energy into the lamp. A more prevalent form of ballast employs another electrical component called an "inductor," which generally comprises a coil of wire wrapped around a metal core. Many different circuits have been used to start and run conventional fluorescent lamps. The design of a conventional ballast is based on input power voltage, tube length and size, initial cost, long term cost and other factors. (See Wikipedia).

Supplying Power to a Fluorescent Lamp

Conventional fluorescent lamps may be powered by a direct current (DC), which flows in a steady stream, and which does not vary with time. In DC powered fluorescent lamps, the ballast must be resistive, and consumes about as much power as the lamp. Current day fluorescent lamps are almost never powered by direct current. Instead, the vast majority of present day fluorescent lamps run on alternating current (AC), which rises and falls in a regular cycle. FIGS. 4 and 5 furnish two graphs that compare direct current and alternating current.

More recent "electronic" ballasts utilize transistors or other semiconductor components to convert household voltage (120 VAC) into high-frequency alternating current.

Beginning in the 1990's, a new type of ballast was introduced to the market. "High frequency" ballasts use high frequency voltage to excite the mercury within the lamp. These newer electronic ballasts convert the 60 Hertz household alternating current to a high frequency signal that can exceed 100 kHz. (See Wikipedia).

Present day conventional ballasts and fluorescent lamps are hampered by serious limitations. First, they consume substantial amounts of power. Second, they are not dimmable over a complete range of brightness. Third, every ballast must be especially configured for the particular fluorescent lamp with which it is to be used.

The development of an energy control device system that overcomes these limitations and that provides a substantial reduction in energy consumption would constitute a major technological advance, and would satisfy long felt needs and aspirations in the lighting industry, and would also satisfy pending and imminent regulatory demands.

SUMMARY OF THE INVENTION

One embodiment of the present invention comprises a Fluorescent Lighting System. One embodiment of the invention may be used to control the operation of a fluorescent lamp. One embodiment utilizes a circuit that enables light output dimming to one half of the maximum light output of the lamp, while simultaneously reducing energy consumption by fifty percent.

An appreciation of the other aims and objectives of the present invention and a more complete and comprehensive understanding of this invention may be obtained by studying the following description of a preferred embodiment, and by referring to the accompanying drawings.

A BRIEF DESCRIPTION OF THE DRAWINGS

Figure 1:
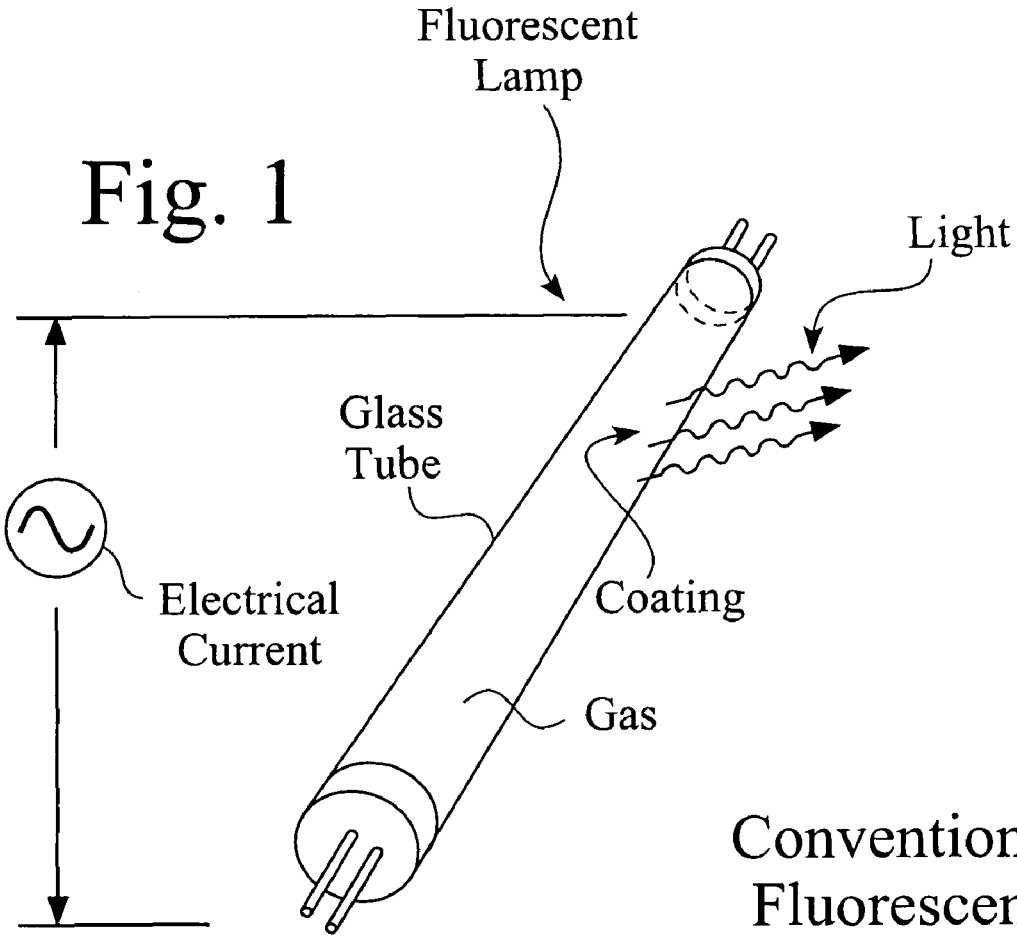
FIG. 1 depicts a conventional fluorescent tube.
Figure 2:
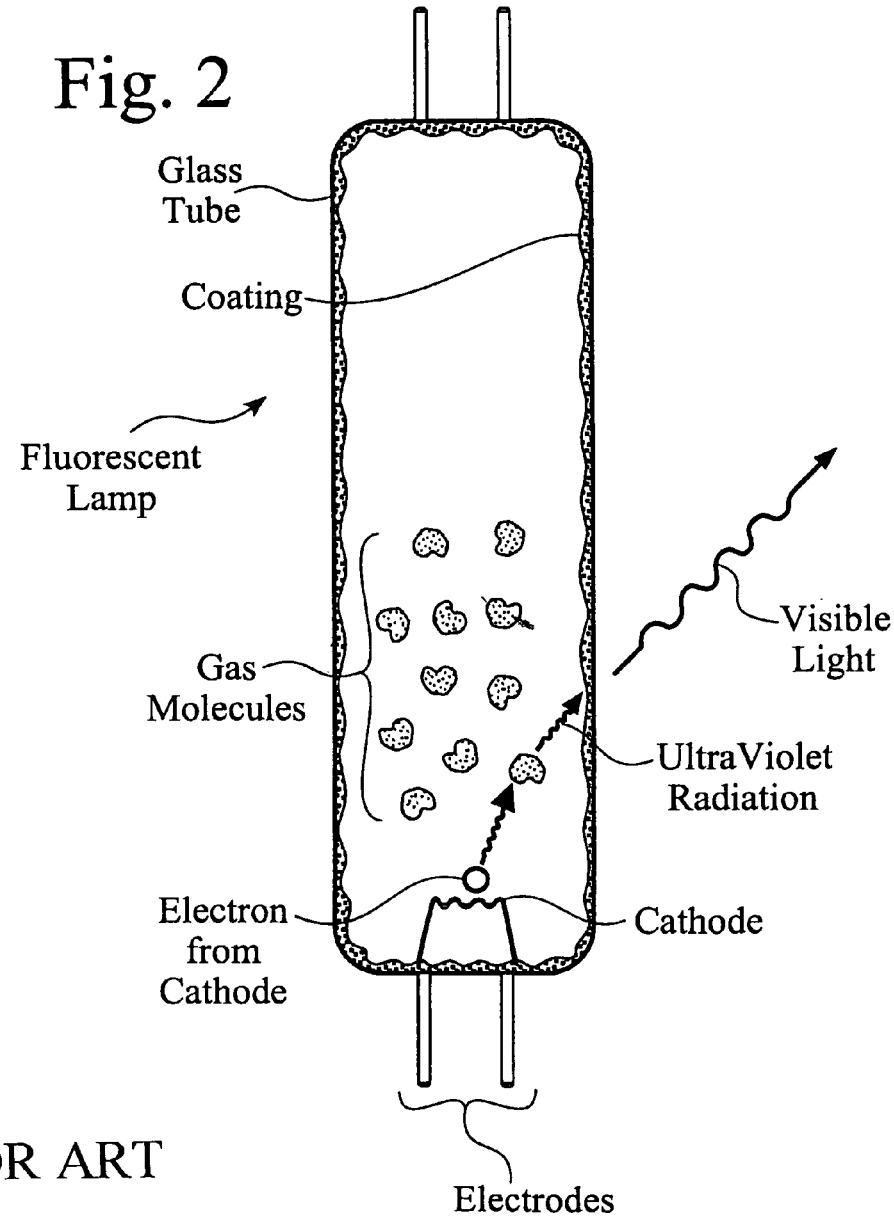
FIG. 2 shows how a conventional fluorescent tube operates.
Figure 3:
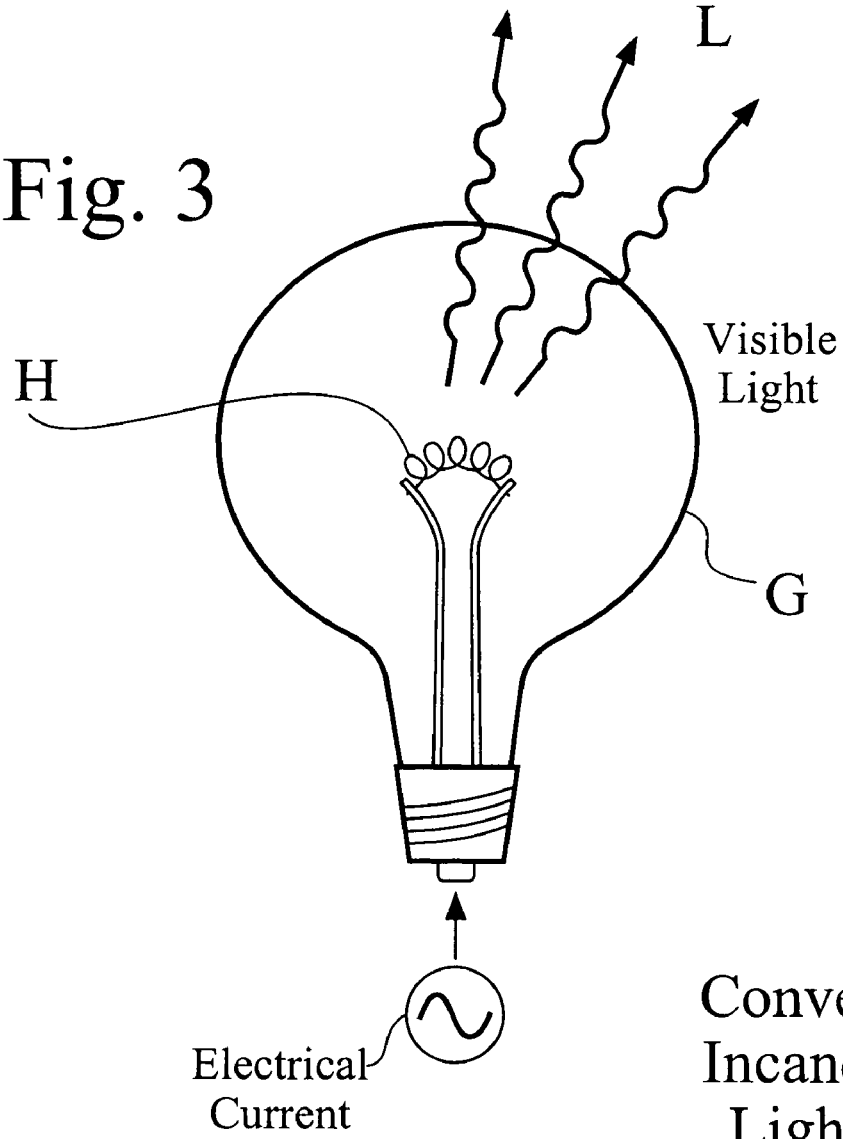

FIG. 3 portrays the operation of a conventional incandescent light bulb.

Figure 5:
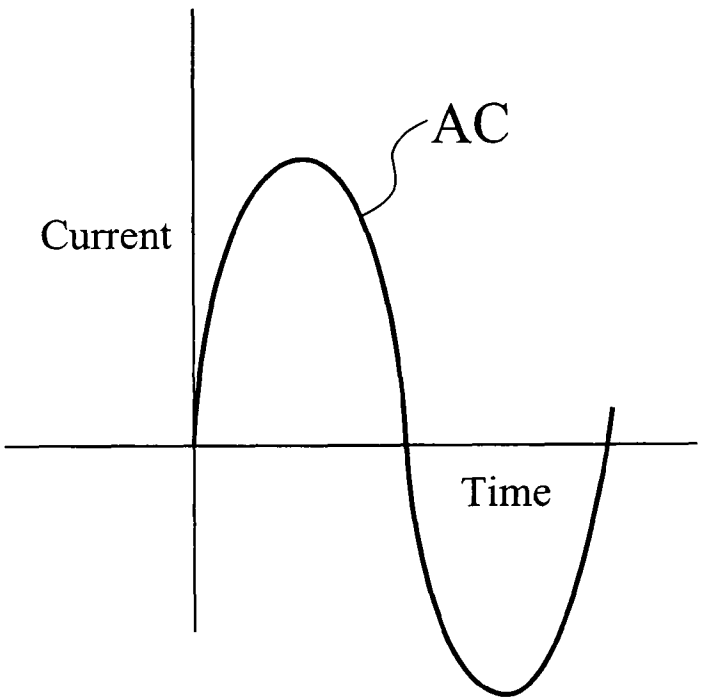
Figure 4:
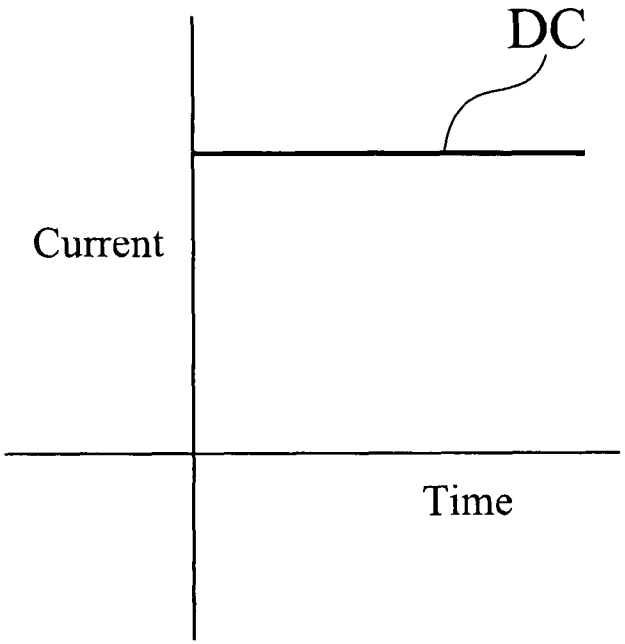

FIGS. 4 and 5 are graphs that compare direct and alternating current waveforms.

Figure 6:
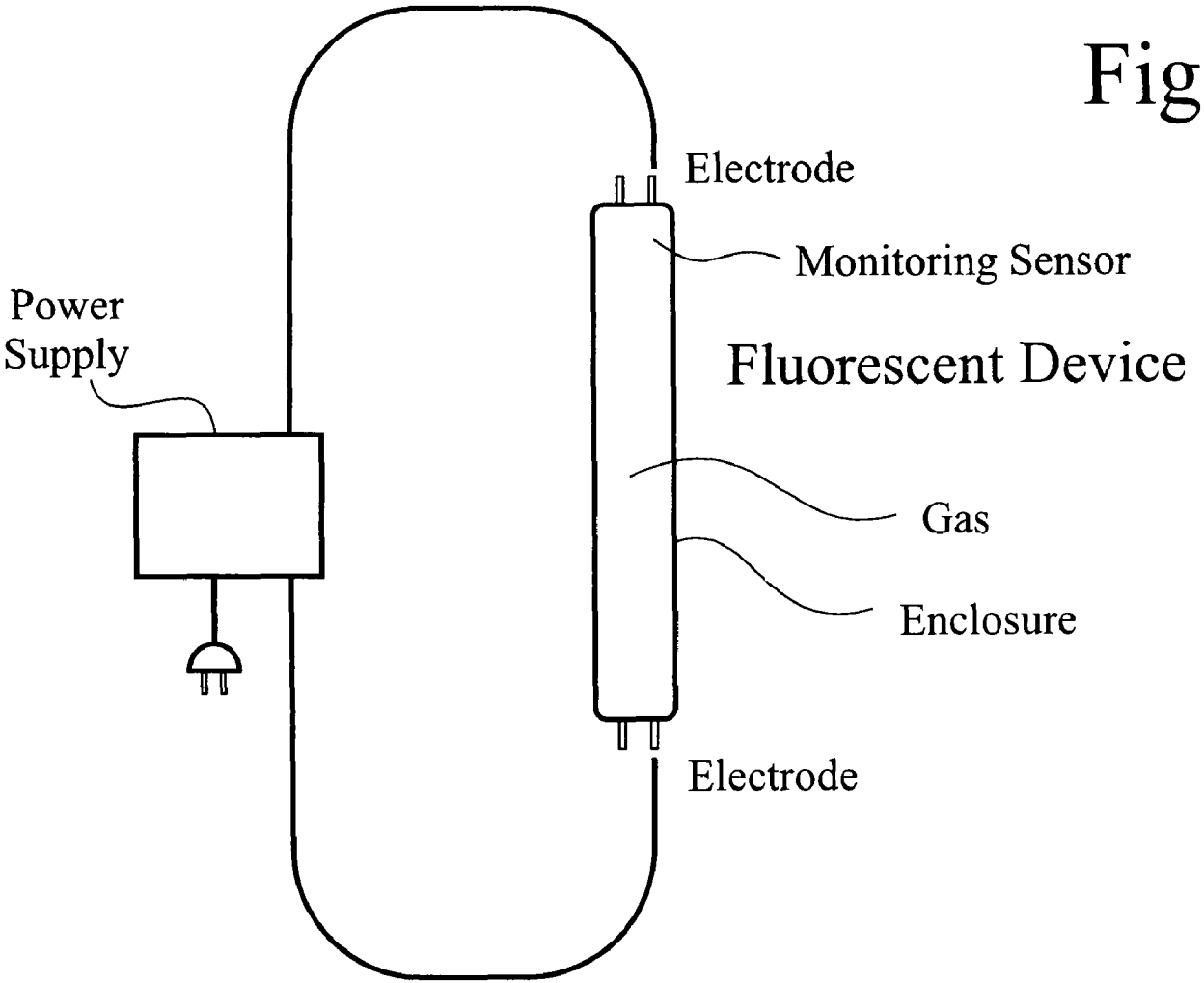

FIG. 6 presents a generalized diagram which portrays one embodiment of the present invention.

Figure 7:
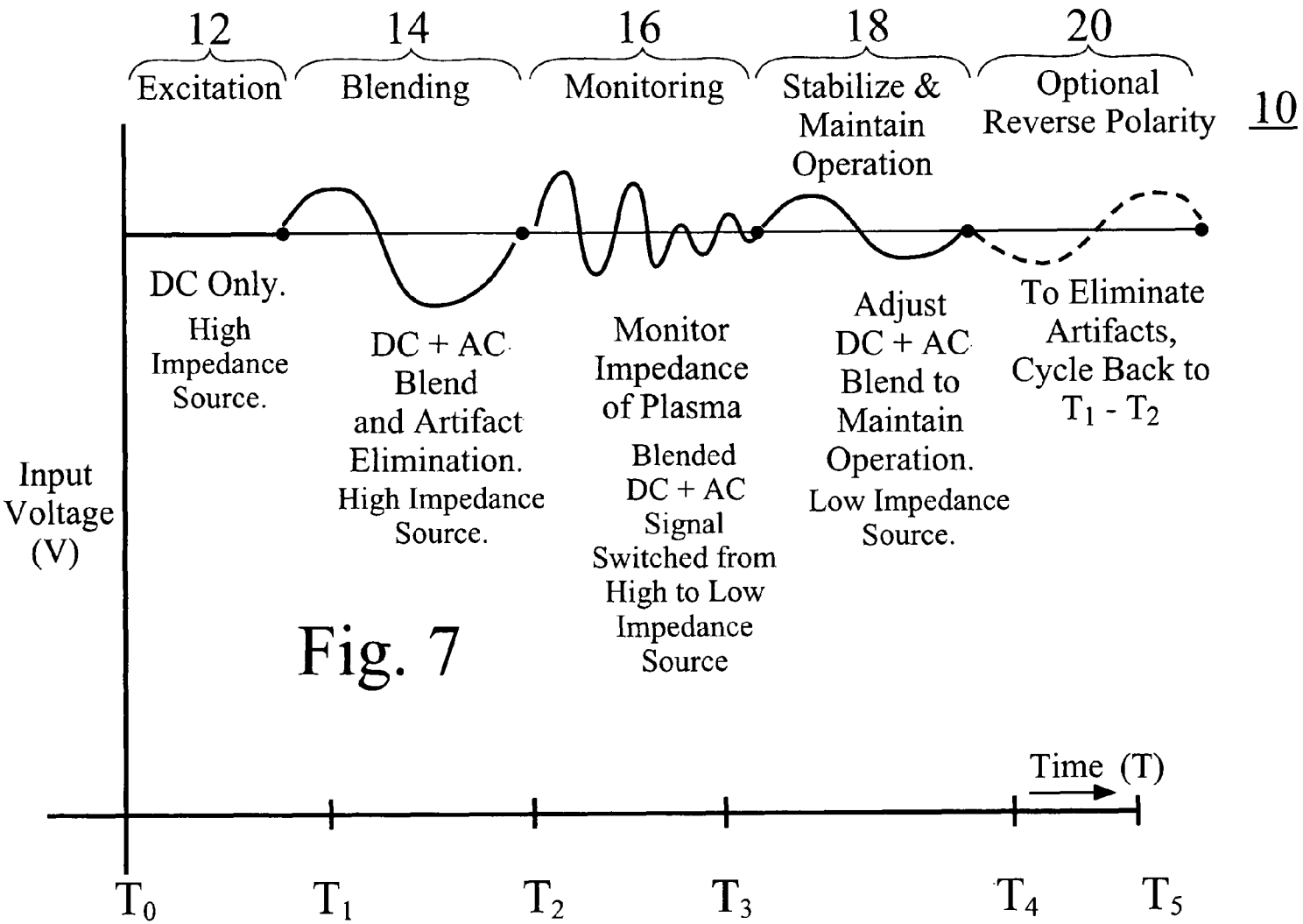

FIG. 7 is a graph of input voltage versus time.

Figure 8:
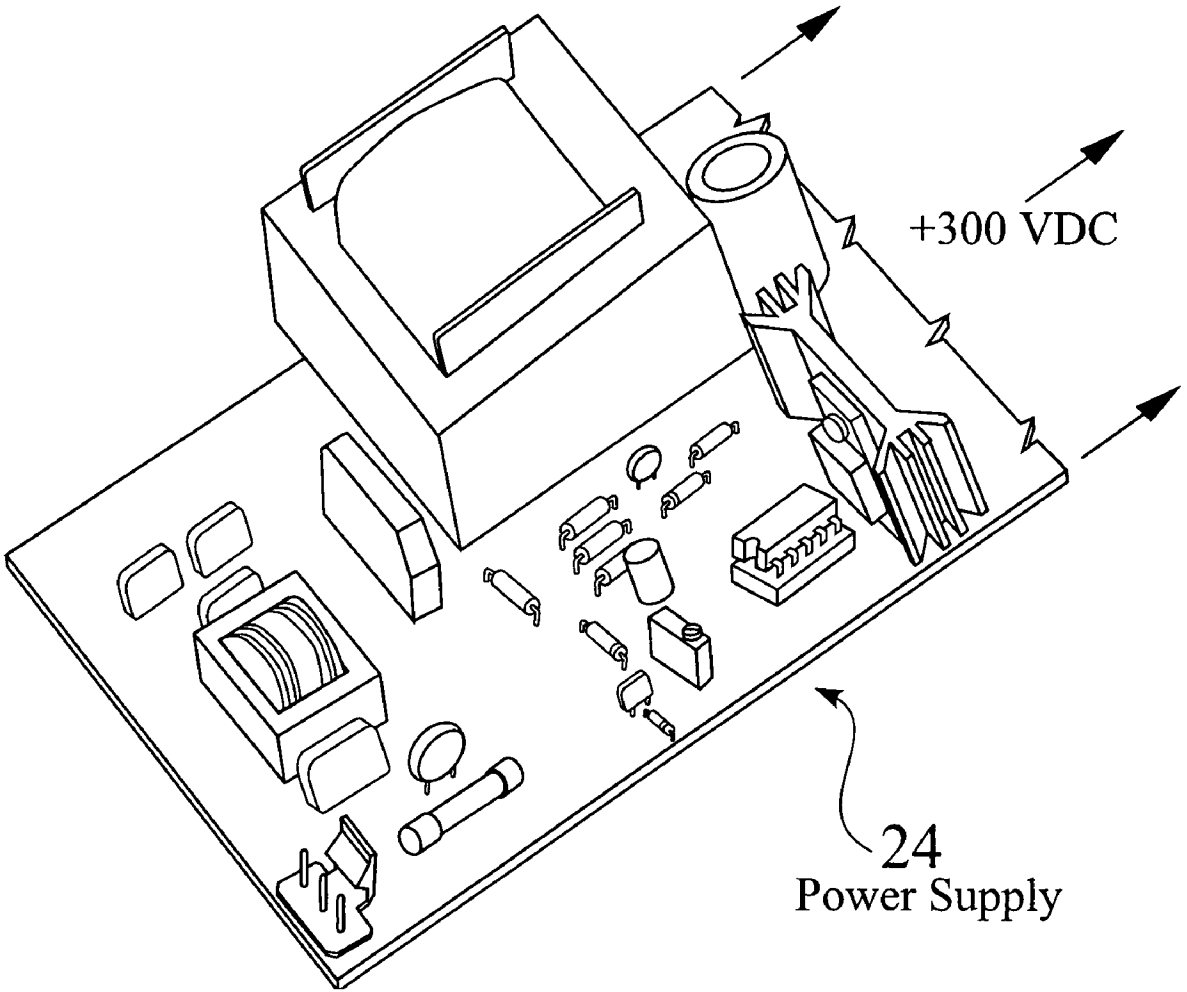

FIG. 8 is a perspective view of a circuit board and components that may be used to implement one embodiment of the present invention.

Figure 9:
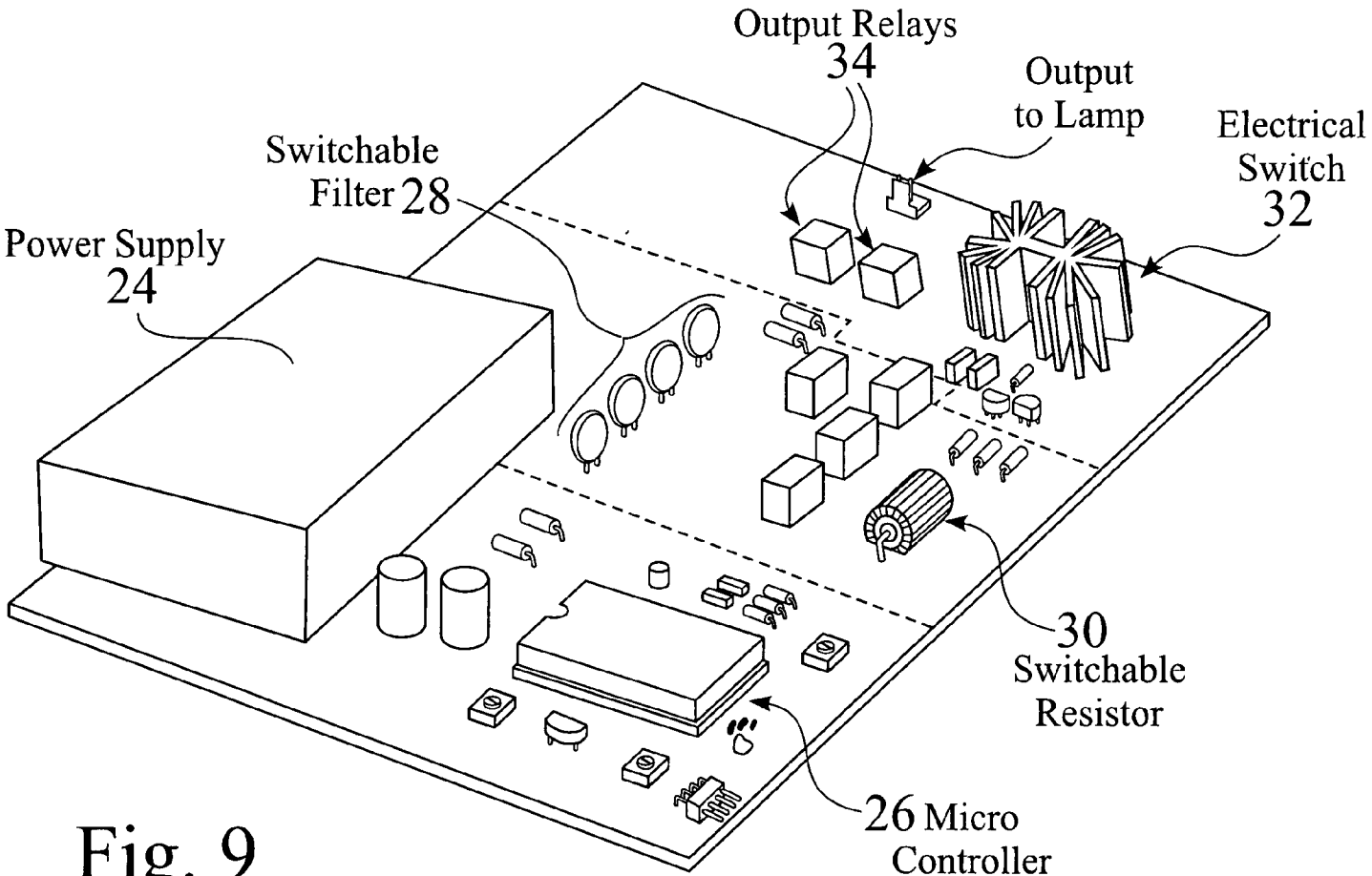

FIG. 9 is a perspective view of another circuit board and components that may be used to implement one embodiment of the invention.

Figure 10A:
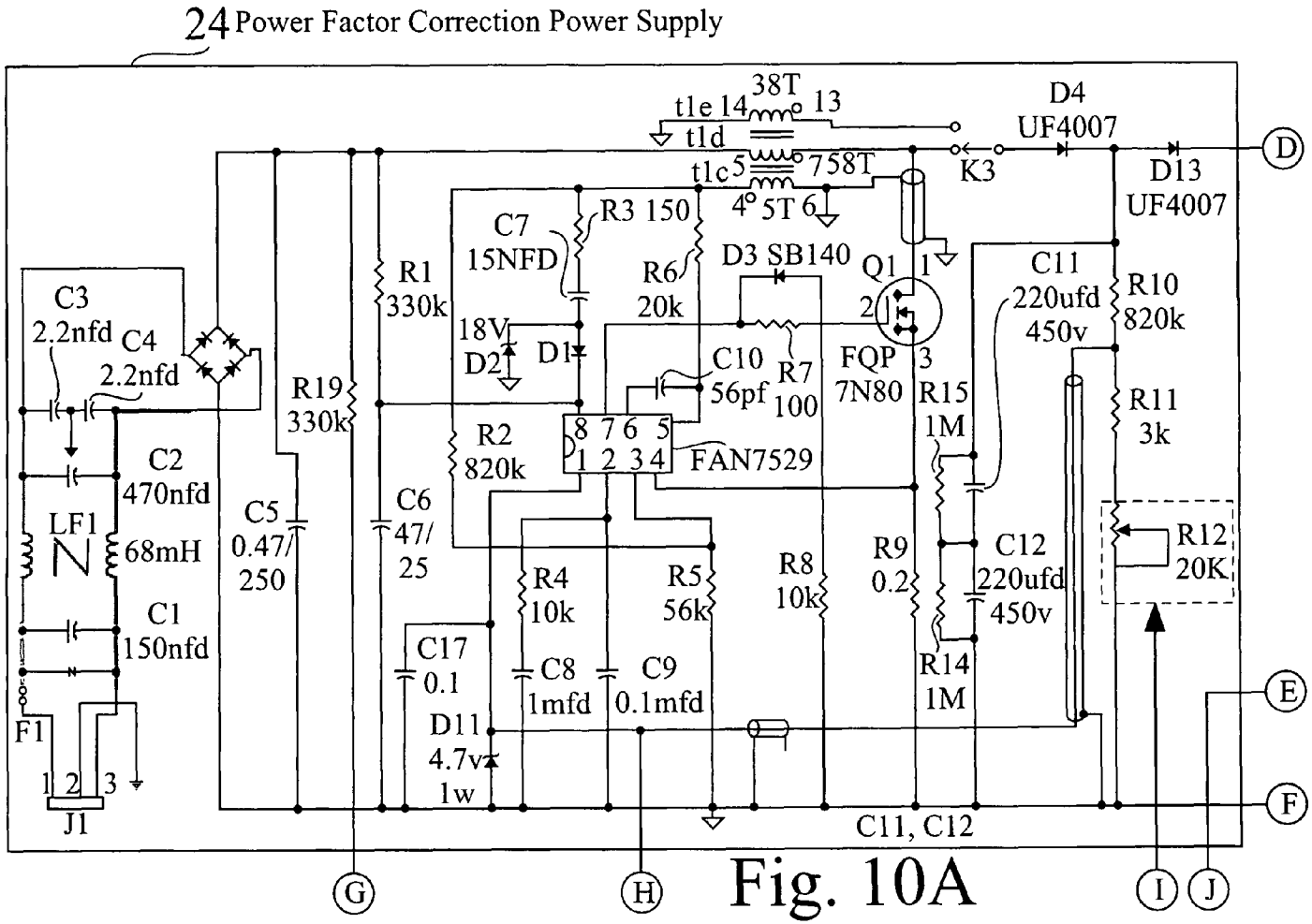
Figure 10B:
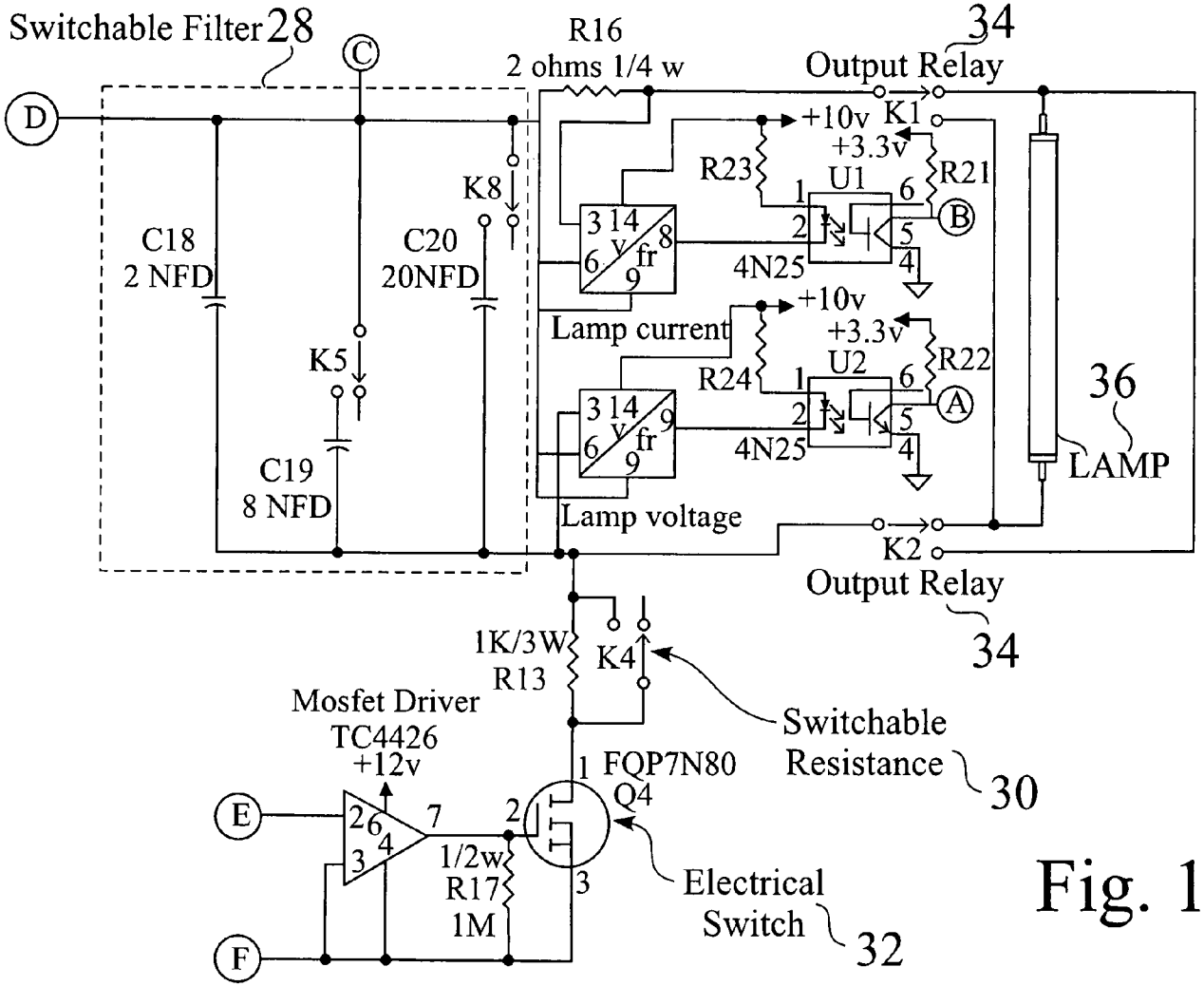
Figure 10C:
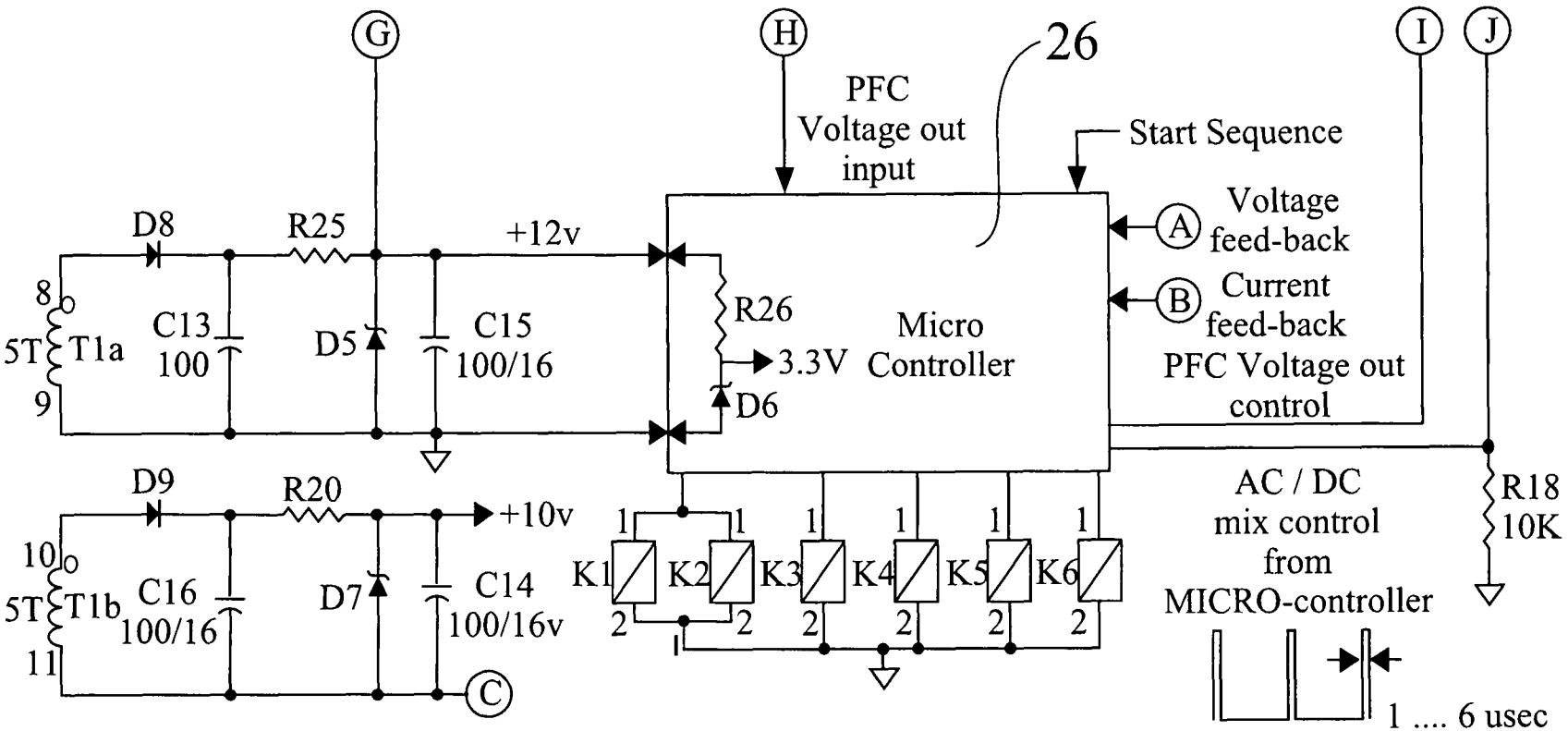

FIG. 10 is a schematic diagram of the components of the circuit boards shown in FIGS. 8 and 9.

A DETAILED DESCRIPTION OF PREFERRED & ALTERNATIVE EMBODIMENTS

The present invention comprises methods and apparatus for operating a highly efficient and dimmable fluorescent illumination device. In general, one embodiment of the invention provides for confining a plasma, and then stimulating the plasma with electrical energy to form a conductive plasma channel. This plasma drives the production of visible light by stimulating a photoluminescent substance surrounding the plasma. The impedance of the plasma channel, which varies with time and with ambient conditions, is then measured, and then the electrical input which maintains the plasma channel is adjusted to optimize its electrical impedance to provide efficient illumination. In another optional step, the polarity of the input waveform to the lamp is periodically reversed to eliminate any artifacts.

FIG. 6 reveals a fluorescent device connected to a power supply. The fluorescent device comprises a sealed enclosure which contains a number of molecules of gas which are capable of being ionized. In one embodiment of the invention, the enclosure is an optically transmissive substance, such as a cylindrical glass tube. In another embodiment of the invention, the enclosure may be a compact fluorescent bulb, configured as a spiral. The interior surface of the enclosure is coated with a light emitting substance. In one embodiment of the invention, the light emitting substance is a fluorescent or phosphorescent coating, which produces light when stimulated by ultraviolet radiation. One or more electrodes are located at either end of the tube, and generally extend from the outside of the tube into the enclosure. The electrodes may be disposed as pins, or may be connected through an electronic circuit to a threaded conductive end portion which fits into a standard light socket.

In accordance with one of the methods of the present invention, a first electrical signal is applied across the electrodes of the enclosure, as shown in FIG. 7. In one embodiment, this first electrical signal is a high voltage direct current voltage which excites the gas inside the enclosure, and which causes the gas to ionize, forming a plasma. This first electrical signal comes from a high impedance source. This first electrical signal is applied for a time $T_1$-$T_0$, which is labeled on the x-axis as the "Excitation Phase" of operation of the fluorescent device. The plasma is capable of conducting electricity between the electrodes through the center of the tube. The plasma generates ultra-violet radiation, which stimulates the phosphorescent coating of the inside of the tube, and produces visible light.

In the second phase of operation, which occurs between times $T_1$ and $T_2$, and which is labeled "Blending," the first DC signal is blended with an AC signal.

In the third phase of operation, which occurs between times $T_2$ and $T_3$, and which is labeled "Monitoring," the sensor inside the enclosure monitors the impedance of the plasma. When the conditions are correct, the source is switched from high impedance to low impedance.

In the fourth phase of operation, which occurs after time $T_3$, and which is labeled "Stabilizing & Maintaining Operation," an adjusted blend of DC and AC input signals are applied to the electrodes of the enclosure to maintain the optimal operation of the fluorescent device.

In an optional fifth phase of operation, which is labeled "Optional Polarity Reversal," which may occur after time $T_4$ the polarity of the waveform may be reversed to eliminate artifacts.

In one embodiment, the first signal is a relatively high voltage, constant direct current. In one embodiment, this first signal may range from 625 to 700 VDC. In one embodiment, the second signal is a mix of a constant direct current, and an alternating current. In one embodiment, the alternating current may range from 50 to 90 volts, and from 65,000 to 90,000 cycles per second. In an alternative embodiment, a series of direct current pulses may be substituted for the alternating current. In one embodiment, the second electrical signal ranges from 120 to 150 VDC.

In yet another embodiment of the invention, a radio may be attached to or installed inside the enclosure. This radio may be used to communicate to a remote transceiver to optimize the operation of the fluorescent device. A number of fluorescent devices, such as some or all of the bulbs on the floor of an office building, may use these radios to coordinate and control the operation of this group of fluorescent devices. In particular, these radios may be used for automatic dimming. In one embodiment, the radio operates in the Wi-Fi frequency band, and is used to create a Wi-Fi hotspot for telecommunications.

In another embodiment, the power supply for the fluorescent device is built into the enclosure, and the invention operates without an external ballast.

In another embodiment, the interior surface of said enclosure also includes a partially mirrored surface to further enhance the optimization of the production of visible light from the light emitting substance on said interior surface of the enclosure.

In yet another embodiment of the present invention, priori knowledge of the characteristics of the enclosure are used to optimize the production of visible light from the fluorescent device.

FIGS. 8 and 9 offer pictorial view of one embodiment of circuit boards which may be used to operate a fluorescent device in accordance with the present invention.

FIG. 10 provides a schematic diagram of the electronic components comprising the circuit boards shown in FIGS. 8 and 9.

The current through the lamp is monitored by the microcontroller when it interprets the frequency of the voltage pulse output from the optical isolator U-1 which is shown in FIG. 10. This frequency is generated by a "voltage to frequency" converter that samples the voltage developed across resistor R-16 which is shown in FIG. 10. The voltage across the lamp is monitored by the microcontroller when it interprets the frequency of the voltage pulse output from the optical isolator U-2 which is shown in FIG. 10. This frequency is generated by a "voltage to frequency" converter that samples the voltage developed between the common connection on output relay K-1 and the common connection on output relay K-2, which is shown in FIG. 10.

From these monitored quantities, the microcontroller calculates the lamp mean impedance characteristic. With this characteristic and the measured lamp mean current value, the microcontroller initiates the appropriate action by altering the voltage parameters applied to the lamp. For example, an F32T8 lamp operating at 100% illumination exhibits high efficiency when the measured mean current value is 0.180 ampere and the calculated mean impedance characteristic is 685 ohms. If the ambient temperature decreases, the lamp mean impedance characteristic will increase and the lamp efficiency will decrease. The microcontroller will react by adjusting the D.C. plus A.C. voltage amplitude and blend, applied to the lamp, to maintain 0.180 amperes and manage the impedance back to 685 ohms. High efficiency operation is restored.

The ballast microcontroller is also capable of dimming the light output. For example, the F32T8 lamp operates at high efficiency, at an illumination level of 37.5%, if the lamp means current value is 0.06 ampere and the calculated mean impedance characteristic is 2500 ohms. This is accomplished and maintained, by the microcontroller adjusting the D.C. plus A.C. voltage amplitude and blend applied to the lamp.

II. Ballast Circuitry

One embodiment of the invention includes a microcontroller and firmware combination, a power supply, an electrical switch, a switchable resistance, a switchable filter and one or more relays that are used to reverse the polarity of the input applied to the lamp. Each component is described below.

Power Supply

In one embodiment, the present invention works in combination with a power supply that converts incoming power line voltage, typically 110 VAC RMS, to an adjustable 100 VDC to 700 VDC at 100 watts. The power supply accomplishes this conversion from alternating to direct current while always making itself appearing as a resistive load to the incoming power line. This ability is called power factor correction (PFC). The circuit which accomplishes this task is readily available from a range of manufacturers. In one embodiment of the invention, a Fairchild model FAN7529 is employed as the power supply. See application note AN-6026. the output voltage is controlled by the microcontroller.

Electrical Switch

In one embodiment, the present invention also works in combination with a one input electrical. switch, which is used to control power fed to the lamp. When turned on its resistance should be less 0.3 ohms. When turned off, the break down voltage of the switch must be greater than 800 Volts. The switch is controlled by applying a voltage level shift which is supplied to a third connection on the switch. One embodiment of the invention utilizes a model FQP7N80 made by Fairchild. The electrical switch must be fast, making the transitions between states in less than 200 nanoseconds ($200\times10^{-9}$ seconds).

Microcontroller and Firmware

In one embodiment, the present invention is also used in combination with a microcontroller and firmware. The microcontroller converts analog to digital and digital to analog, and must operate fast enough to perform calculations and run the ballast circuitry. A clock frequency of 20 MegaHertz is recommended. The recommended microcontroller family for one embodiment is the Zilog Z8 encore line.

The firmware monitors the amount of voltage and current that crosses and runs through the fluorescent lamp. The firmware must be capable of receiving an energy level instruction from an operator using the standard lighting industry communication protocols. The microcontroller may also be used to analyze the fluorescent lamp's condition, communicate the lamp type, and communicate that condition to the operator.

Switchable Filter

In one embodiment, the present invention is also used in combination with a switchable filter. The filter resides in series between the power supply and the electrical switch, and it parallels the lamp and works with the switch to control the makeup (the alternating and direct current levels) of energy that powers the lamp. The fluorescent lamp performs best when the energy fed to lamp is filtered to be a mixture of 96-98% DC current and 2-4% AC current. The filter is switchable because its characteristics change depending on the level to which the lamp is being driven.

Resistive Switch

In one embodiment, the present invention includes a switchable resistance. The switchable resistance resides in series with the power supply. The resistance is used to limit energy transfer to the lamp during the excitation and blending phases of operation. This occurs between $T_0$ and $T_2$, as shown in FIG. 7. Once past the blending phase and into the monitoring phase of operation, the resistance is switched out of the circuit. It is no longer used, unless it is needed to return to the blending phase for artifact elimination.

Output Relay

In one embodiment, the present invention includes an output relay. The output relay resides between the switchable filter and the lamp. The relay is used to reverse the polarity of the electrical energy driving the lamp. Polarity reversal is utilized during the excitation phase of operation, $T_0$ to $T_1$, as shown in FIG. 7, and during the blending phase of operation, $T_1$ to $T_2$, as shown in FIG. 7.

Conclusion

Although the present invention has been described in detail with reference to one or more preferred embodiments, persons possessing ordinary skill in the art to which this invention pertains will appreciate that various modifications and enhancements may be made without departing from the spirit and scope of the Claims that follow. The various alternatives that have been disclosed above are intended to educate the reader about preferred embodiments of the invention, and are not intended to constrain the limits of the invention or the scope of Claims.

List of Reference Characters

10 Voltage Diagram
12 Excitation phase
14 Blending phase
16 Monitoring phase
18 Stabilization & Maintenance
20 Optional Reverse Polarity
22 Power supply circuit board
24 Power factor correction power supply
26 Microcontroller
28 Switchable filter
30 Switchable resistor
32 Electrical switch
34 Output relays
36 Lamp

What is claimed is:

1. A method comprising the steps of:
supplying a sealed enclosure for providing illumination;
said enclosure containing a plurality of molecules of a gas;
said enclosure having an interior surface; said interior surface being at least partially coated with a light emitting substance;
said enclosure including a first and a second electrode;
applying a first electrical signal across said first and said second electrodes to excite some of said plurality of molecules of a gas and to produce an ionized cloud within said enclosure; and
applying a second electrical signal across said first and said second electrodes along with said first electrical signal to maintain said ionized cloud within a set of predetermined limits to optimize the production of visible light from said light emitting substance on said interior surface of said enclosure and
said second electrical signal including a series of direct current pulses to maintain said ionized cloud which was initiated by said first electrical signal;
said second electrical signal is provided by a low impedance source.

2. A method as recited in claim 1, further comprising the steps of:
sensing the electrical impedance of said ionized cloud; and
varying said second electrical signal to optimize the production of visible light from said light emitting substance on said interior surface of said enclosure.

3. A method as recited in claim 1, further comprising the step of:
sensing an artifact; and
reversing the polarity of said second electrical signal to eliminate said artifact.

4. A method as recited in claim 1, in which:
said enclosure is formed from an optically transmissive substance.

5. A method as recited in claim 1, in which:
said enclosure is formed from glass.

6. A method as recited in claim 1, in which:
said enclosure is generally cylindrical.

7. A method as recited in claim 1, in which:
said enclosure is generally configured as a cylindrical spiral.

8. A method as recited in claim 1, in which:
said enclosure is a portion of a compact fluorescent bulb.

9. A method as recited in claim 1, in which:
said gas being selected to at least partially ionize when stimulated with electrical energy.

10. A method as recited in claim 1, in which:
said light emitting substance is fluorescent.

11. A method as recited in claim 1, in which:
said light emitting substance is phosphorescent.

12. A method as recited in claim 1, in which:
said first and said second electrodes being located generally at each end of said enclosure.

13. A method as recited in claim 1, in which:
said first and said second electrodes are each connected to one pair of external electrodes.

14. A method as recited in claim 1, in which:
said first and said second electrodes are each connected to a portion of a threaded conductive base that is configured to fit inside a conventional light bulb socket.

15. A method as recited in claim 1, in which:
some of said plurality of molecules of a gas become ionized when stimulated with electrical energy.

16. A method as recited in claim 1, in which:
said light emitting substance emits photons when some of said plurality of molecules of gas are ionized.

17. A method as recited in claim 1, in which:
said first electrical signal is a direct current.

18. A method as recited in claim 1, in which:
said first electrical signal is provided by a high impedance source.

19. A method as recited in claim 17, in which:
said direct current ranges between approximately 625 and 700 volts.

20. A method as recited in claim 1, in which:
said second electrical signal provides a mix of said direct current and an alternating current.

21. A method as recited in claim 20, in which:
said alternating current ranges approximately between 50 and 90 volts.

22. A method as recited in claim 1, in which:
said second electrical signal ranges approximately between 120 and 150 VDC.

23. A method as recited in claim 20, in which:
said alternating current has a frequency approximately between 65,000 and 90,000 cycles per second.

24. A method as recited in claim 1, in which:
said first electrical signal has a voltage range which depends upon the dimensions of said enclosure.

25. A method as recited in claim 1, in which:
said first electrical signal has a voltage range which depends upon the characteristics of said gas.

26. A method as recited in claim 1, in which:
said second electrical signal has a voltage range which depends upon the dimensions of said enclosure.

27. A method as recited in claim 1, in which:
said second electrical signal has a voltage range which depends upon the characteristics of said gas.

28. A method as recited in claim 1, further comprising the step of:
installing a radio inside said enclosure.

29. A method as recited in claim 1, further comprising the step of:
attaching a radio to said enclosure.

30. A method as recited in claim 29, in which:
said radio is used to convey radio signals to help optimize the operation of a plurality of said enclosures.

31. A method as recited in claim 29, in which:

said radio is used to convey radio signals to furnish automatic dimming for a plurality of said enclosures.

32. A method as recited in claim 29, in which:

said radio operates in the Wi-Fi frequency band.

33. A method as recited in claim 29, in which:

said radio creates a Wi-Fi hotspot.

34. A method as recited in claim 1, further comprising the step of:

generating visible light using said enclosure without requiring an external ballast.

35. A method as recited in claim 29, in which:

said radio is also used for telecommunications.

36. A method as recited in claim 1, in which:

said interior surface of said enclosure also includes a partially mirrored surface to further enhance the optimization of the production of visible light from said light emitting substance on said interior surface of said enclosure.

37. A method as recited in claim 1, further comprising the step of:

using a priori knowledge of the characteristics of said enclosure allow for enhanced optimization of the production of visible light from said light emitting substance on said interior surface of said enclosure.

38. A method as recited in claim 30, in which:

said enclosure generates visible light; the intensity of said visible light being dimmable by adjusting said second electrical signal.

* * * * *